United States Patent [19]

Fidi et al.

[11] Patent Number: 4,572,324

[45] Date of Patent: Feb. 25, 1986

[54] EAR PIECE CONSTRUCTION

[75] Inventors: Werner Fidi, Baden; Friedrich Richter, Klosterneuburg, both of Austria

[73] Assignee: AKG Akustische u.Kino-Geräte Gesellschaft mbH, Austria

[21] Appl. No.: 608,973

[22] Filed: May 10, 1984

[30] Foreign Application Priority Data

May 26, 1983 [AT] Austria ..... 1930/83

[51] Int. Cl.[4] ..... H04R 25/00

[52] U.S. Cl. ..... 181/129; 179/156 R

[58] Field of Search ..... 181/129, 130, 137; 179/156 R, 182 R; 2/6, 423

[56] References Cited

U.S. PATENT DOCUMENTS

| | | | |
|---|---|---|---|
| 3,134,456 | 5/1964 | Wadsworth | 181/129 |
| 3,456,263 | 7/1969 | Aileo | 179/156 R X |
| 4,437,538 | 3/1984 | Ohlsson et al. | 181/129 |

FOREIGN PATENT DOCUMENTS

| | | |
|---|---|---|
| 274918 | 1/1969 | Austria . |
| 1537700 | 3/1972 | Fed. Rep. of Germany . |
| 2252189 | 5/1973 | Fed. Rep. of Germany . |
| 2637336 | 2/1978 | Fed. Rep. of Germany . |

OTHER PUBLICATIONS

Rhenius, "Optimal Offene Kopfhorer", Funkschau (hi-fi), No. 23, 1978, pp. 1159-1161.

*Primary Examiner*—Benjamin R. Fuller
*Attorney, Agent, or Firm*—McGlew and Tuttle

[57] ABSTRACT

An ear piece for a sound producing device such as a headset comprises an annular ear cushion with at least one part of an elastic, soft, sound permeable foam and at least one other part of a sound permeable layer which is thin in relation to the overall thickness of the air cushion and has a defined acoustic impedance for low and medium frequencies of the audibility range. The ear cushion acts as a frictional resistance with a central portion defining coupling space from the sound producing device to the ear and representing an acoustic connection through the sound producing device to the air.

10 Claims, 10 Drawing Figures

EAR PIECE CONSTRUCTION

FIELD AND BACKGROUND OF THE INVENTION

This invention relates in general to sound transmitting devices and in particular to a new and useful ear piece for a sound producing device such as a headset.

The invention relates to an annular ear cushion comprising at least two interconnected parts, one part comprising an elastic, soft, sound permeable material, and an ear cushion associated with a supraaural headset ear piece.

When in use, ear cushions for supraaural headset ear pieces are located between the headset ear piece and the user's outer ear. It is the task of the ear cushion to make wearing a headset over the ear more pleasant, as the ear cushions of the headset ear pieces reduce the pressure exerted by the headset on the outer ear. The pressure against the outer ear is necessary for better acuostic coupling of the headset to the ear, and in many applications as close a seating of the ear cushions against the outer ears is required to achieve optimum acoustic coupling. The ear cushion is often used also to muffle disturbing resonances developing in the coupling space acting as a Helmholtz resonator.

Embodiments in common use and possible applications of ear cushions for headset ear pieces are known from AT-PS 274,918, DE-OS 26 37 336 and the technical journal Funkschau, No. 23,1978, pages 1159–61. But in these ear cushions of the state of the art the defined seating of the headset on the ear and its associated acoustic coupling to the ear is vague, and a precisely reproducible frequency response from the lowest to the medium frequencies transmitted, e.g. from 20 Hz to 2 kHz, cannot be obtained with such ear cushions in a satisfactory manner.

The DE-AS 15 37 700 also refers to the limited quality of headsets, especially at the lower frequencies. To eliminate the undefined conditions of the contact between ear piece and outer ear, the publication proposes to move the diaphragm resonance to the lower end of the transmission range and also to provide special mechanical means to prevent the auditory canal from being sealed from the air space surrounding the head and the electro-acoustic transducer. The DE-OS 22 52 189 also indicates, for a headset with an open backside, for the unequivocal reproduction of a uniform frequency response at low and medium frequencies of the range of audibility, a solution of the not unequivocal conditions present due to the ear cushion, which solution is supposed to be that there are provided in the diaphragm itself or/and in the housing part supporting the diaphragm many small holes to control the leakage from the front to the back of the diaphragm.

SUMMARY OF THE INVENTION

Now, in order to provide ear pieces applicable equally well, not only to one specific embodiment of headset ear pieces, but to all headsets in common use, such as closed, semi-open, and open headsets, the invention aims at creating defined and, hence, precisely reproducible conditions for coupling the headset ear piece to the ear by the simplest possible means, assuring frequency response uniformity within the narrowest tolerances for the lowest to medium frequencies of the range of audibility. According to the invention, this is achieved for an ear cushion comprising at least two interconnected parts in that one part of the cushion is designed in the form of an annular, sound permeating layer which is thin in relation to the overall thickness of the annular cushion and has a defined acoustic impedance for low and medium frequencies of the audibility range, acting primarily as frictional resistance, and representing an acoustical connection leading, in the position in which it is used, out of the coupling space between headset ear piece and ear into the open space outside of the headset ear piece.

The annular cushion according to the invention, designed in the manner of a sandwich, has the great advantage that the sound impermeable part of the elastic, soft and resilient foam rests plesantly but acoustically tight against the outer ear. The resilience of the material permits the ear cushion to adapt to the shape of the outer ear, thereby sealing the unevenness and curved cavities of the outer ear. The annular layer, united with the ear cushion, is designed so that it will almost not, or not at all, deform mechanically, thereby creating defined acoustic conditions out of the coupling space into the space outside of the headset and around the head. Regardless of the shape of individual outer ears, and also regardless of the locally different seating of the headset when worn repeatedly, a uniformly reproducible frequency response is absolutely assured in the entire transmission range.

The invention also offers the advantage that the connection leading out of the coupling space to the outside around the headset ear piece ventilates the ear covered by the ear cushion, suppressing the buildup of heat on the outer ear when the headset is worn for longer periods of time. Using headsets equipped with such ear pieces increases the wearing comfort considerably because the known, uncomfortable heating of the ear, usually associated with itching, does not occur even when the headset is worn for very long periods of time.

In a first embodiment example, the annular, sound impermeable part of the cushion, comprising an elastic, soft foam, is constituted of two sections, between which the sound permeable layer, which is thin in relation to the overall thickness of the cushion, is disposed. With this arrangement, good adaptation of the ear cushion to the head shape all around the user's ear is achievable.

But the annular ear cushion may also be designed so that the thin, annular layer is disposed on the cusion surface facing the ear. This kind of embodiment of the ear cushion according to the invention can be produced very simply because the cushion comprises only two layers, a relatively thin one in contact with the ear, and creating defined conditions, and a sound impermeable and soft, elastically deformable one, adjacent to the former, which is oriented toward the headset. The advantages of the invention already mentioned above can be realized in this simple embodiment also.

To minimize the production costs of the ear cushion, the annular ear cushion is designed so, according to another feature of the invention, that the thin, annular layer forms part of a sound permeable disc facing the ear and contacting the outer ear.

The measure, taken according to the invention, of creating defined acoustic conditions by means of the annular ear cushion of the headset ear pieces when wearing the headset is realized in that the thin, annular layer comprises reticulated foam. Reticulated foam has a completely open-pored structure comprising, by the nature of the manufacturing process, of webs limiting a kind of three-dimensional lattice, between which webs the individual cavities are disposed. The material so structured is almost rigid mechanically, its cavities forming within two boundary surfaces of the sound impermeable, soft-elastic foam parts of the ear cushion, an acoustically defined layer which is independent of mechanical influences and acts almost exclusively as acoustic impedance provided with friction, because on account of the dimensioning the acoustic reactive component of the impedance, present due to the air mass moved, remains negligibly small in relation to the friction for low and medium frequencies. The layer comprising a reticulated foam, and thin in relation to the overall thickness of the air cushion, is not being changed mechanically and acoustically, when the cushion is not being changed mechanically and acoustically when the cushion rests against the ear. The structure of the material provides unequivocal conditions because the deformation of the ear cushion, caused by its contact with the ear, does not influence the acoustic characteristic of the annular gap. At any rate, the tolerance of the acoustical values, which change only extremely little, is so small that the conditions created can practically be considered constant.

Another embodiment of the invention is seen in that the thin annular layer comprises sintered, thermoplastic beads or particles. Such an ear cushion is as good in its wearing comfort as one described above and fulfills the inventive idea in the highest degree. The thin, round ring, produced by sintering thermoplastic beads or particles and forming the center part of the ear cushion constructed in the manner of a sandwich, represents an extremely sound permeable layer acting in the frequency range in question as acoustic impedance provided with friction only.

Another advantageous embodiment of the invention provides for the thin, annular layer to consist of a three-dimensional woven metal lattice structure.

Finally, in a further development of the invention the cushion opening facing the user while using the headset is covered by a thin, elastic, sound permeable textile or plastic layer. It turns out to be not only necessary, but also particularly useful to protect the ear cushion against getting dirty and the headset ear piece adjoining the ear cushion against dust. Moreover, some textiles have the property of having a cooling effect when in contact with the human skin and here in particular with the outer ear, which is no doubt perceived as being pleasant and as increasing the wearing comfort of the headset equipped with such cushions.

Accordingly, it is an object of the invention to provide an ear piece for a sound producing device which comprises an annular ear cushion having at least one part of an elastic soft sound impermeable foam and at least one other annular part of a sound permeable layer which is thin in relation to the overall thickness.

A further object of the invention is to provide an ear piece for a sound producing device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
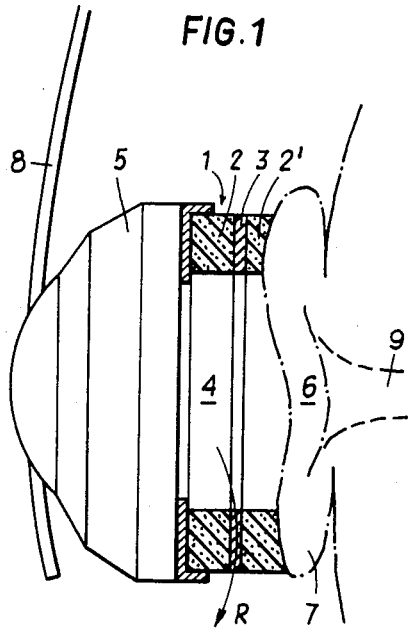
FIG. 1 is a transverse sectional view showing an ear piece of a headset constructed in accordance with the invention.

Referring to the drawings in particular the invention embodied therein comprises an ear piece or ear cushion generally designated 1 for a sound producing device such as a headset 5 which is supported on a headset bow or head piece. In accordance with the invention the ear piece comprises an annular ear cushion with at least one part 2 of an elastic soft, sound impermeable foam and at least one other annular part 3 of a sound permeable layer which is thin in relation to the overall thickness of the air cushion 1. The part 3 has a defined acoustic impedance for low and medium frequencies of the audibility range and acts as a frictional resistance. The central portion 4 defines a coupling space from the sound producing device 5 to the person's ear auditory canal 9. The ear piece 1 represents an acoustic connection from the device 5 to the ear.

FIG. 1 reveals the principle of the ear cushion 1 according to the invention whose transverse section shows its design in the manner of a sandwich. The ear cushion 1 is of annular shape and comprises elastic, soft and sound impermeable foam parts 2, 2' between which is disposed the annular layer 3 according to the invention, which layer is thin in relation to the overall thickness of the ear cushion 1. The layer 3 is sound permeable and has a defined impedance R acting primarily as friction for low and medium frequencies of the audibility range. Due to the sound permeable layer 3, a connection from the coupling space 4 between headset ear piece 5 and ear 6 to the open space outside of the ear piece is created. The ear cushion 1 is pressed by the spring force of a headset bow 8 against the outer ear 7 via the headset ear piece 5, whereby the soft, elastic, sound impermeable foam part 2 of the annular ear cushion 1 adapts in soundtight fashion to the outer ear 7. Via the coupling space 4 the headset ear piece 5 is acoustically coupled to the ear 6 and the auditory canal 9. The sound permeable layer 3 is hardly deformed by the bearing pressure of the ear cushion 1 against the outer ear 7 because it consists of a mechanically appropriately rigid and stable material.

Figure 2:
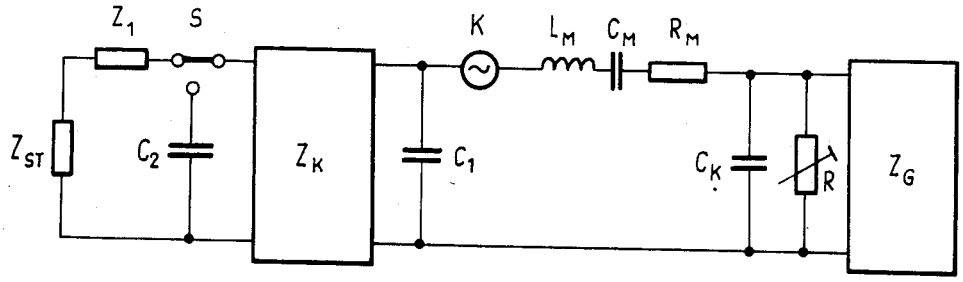
FIG. 2 is a diagrammatical view of an acoustic circuit for the headset shown in FIG. 1.

The operating mode of the ear cushion 1 according to the invention can also be explained by way of the equivalent diagram shown in FIG. 2. The diaphragm, performing attenuated oscillations, is the sound generating element formed of the inductance $L_M$, the capacitance $C_M$ and the frictional resistance $R_M$. The power source K puts it into motion. The ear impedance $Z_G$ is acoustically coupled to the front side of the diaphragm via the coupling space acting as capacitance $C_K$. The actual transducer system of the headset includes the quadripole $Z_K$ which, together with the low chamber behind the membrane, represented as capacitance $C_1$, acts upon the back of the diaphragm. Depending on the style of the headset ear piece, i.e. closed or open, the quadripole $Z_K$ is terminated with a capacitance $C_2$ or an impedance $Z_1$ in series with the radiation resistance $Z_{ST}$. The one type can be converted to the other by means of the switch S. Parallel to the ear impedance $Z_G$ is the resistor R which simulates the defined sound permeability from the coupling space to the open space outside of the headset. Its resistance must be such for low and medium audible frequencies as to assure, together with the impedance of the ear and the reactance of the coupling space, defined conditions, as well as the reproducibility of the frequency for repeated use of the headset.

Figure 3:
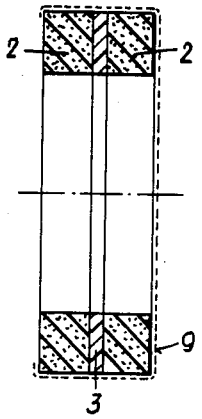
FIGS. 3, 4 and 5 are sectional views similar to FIG. 1 of different embodiments of air cushions usable with the headset shown in FIG. 1.
Figure 4:
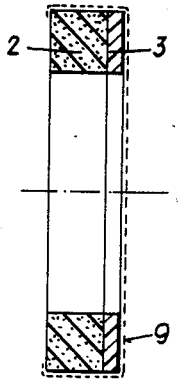
Figure 5:
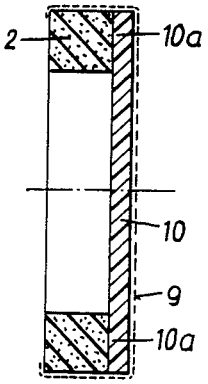
Figure 6:
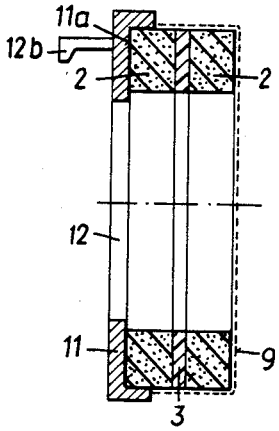
FIGS. 6,7 8 and 10 are views similar to FIG. 3 of different embodiments of the air cushion.

FIGS. 3 through 5 show, in section, embodiment examples of the annular ear cushion 1 according to the invention. The sound permeable, annular layer 3, connecting the space outside of the headset and the coupling space, is disposed in FIG. 3 in the manner of a sandwich between the elastic, soft, sound impermeable foam parts 2. This type of structural design creates particulary good conditions for definitude and reproducibility. The mechanical stability of this sound permeable layer 3 is assured in particular in that it consists either of reticulated foam or of sintered thermoplastic beads or particles, or else is realized by a three-dimensional, woven metal lattice. A cover 9 of a thin, sound permeable textile or plastic material protects the ear cushion from dust and getting soiled.

In FIG. 4 is shown an embodiment example resembling that of FIG. 3. The thin, sound permeable layer 3 is provided on the face of the soft, elastic, and sound impermeable part 2 of the annular ear cushion, facing the outer ear. In an ear cushion so designed, the thin, annular layer 3 can only consist of reticulated foam because this kind of foam guarantees a comfortable as well as pleasant contact with the outer ear without sifnificant mechanical and, hence, also acoustical change of the layer. Here, too, the ear cushion construction of two different foamed materials sees to it that, in the headset position in which it is used, defined reproducibility and frequency response conditions are present. The cover 9 of thin, sound permeable material protects the ear cushion from dust and from getting soiled in this embodiment example also.

For reasons of simpler and also cheaper production it is of advantage to design the thin, sound permeable, annular layer 3 according to FIG. 5 as a disc 10 whose rim 10*a* satisfactorily realizes the layer according to the invention. This embodiment example requires the disc 10 to comprise a reticulated foam as in the embodiment per FIG. 4. The annular, sound impermeable part 2 of the ear cushion, which is thicker by a multiple than the thin layer 10, is made of soft and elastic foam as in the previous embodiment examples. This embodiment also guarantees the defined conditions repeatedly mentioned already when a headset with the ear cushion according to the invention is used on the ear.

Figure 7:
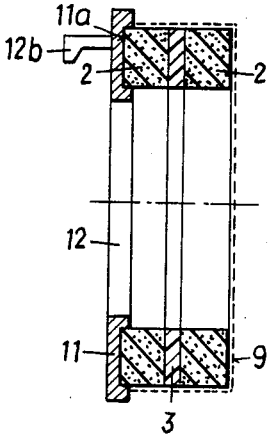
Figure 8:
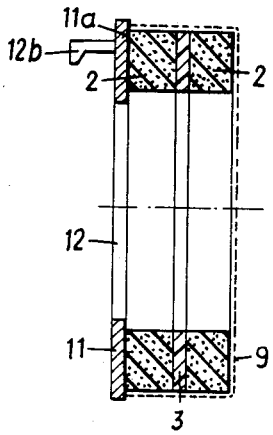
Figure 9:
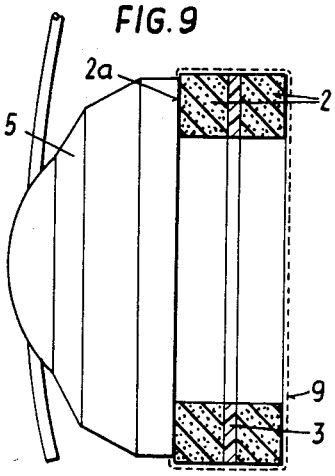
FIG. 9 is a view similar to FIG. 1 of another embodiment of the headset.

Embodiment examples for possible fastening modes of the ear cushion to the headset are shown in FIGS. 6,7,8, and 9. As shown in section in FIGS. 6,7, and 8, one fastening mode presents itself in the form of an annular retaining ring 11 which has protrusions 12*b* near its periphery for attachment to the headset. The surface 11*a* of the soft, elastic, sound impermeable foam ring which faces the headset is glued to this annular retaining ring 11. As may be seen in FIG. 6, the retaining ring 11 may be provided along its edge with a collar for better accommodation of the foam fing. But as FIG. 7 shows, an annular depression is also useful as guide for the sound impermeable foam ring. In the simplest embodiment there is only a ring provided with protrusions, as FIG. 8 shows. If the retaining ring 11 is to be omitted to save costs, the surface 2*a* of the ear cushion facing the headset ear piece is glued to its rim; this fastening mode is shown in FIG. 9 as a partial section.

Figure 10:
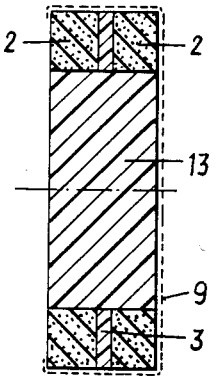

So that the sound radiated by the headset can reach the ear unhindered, the round opening 12 of the retaining ring 11 is nearly as big as that of the annular ear cushion 2. The space contained in the annular cutout of the ear cushion may be filled, as shown in FIG. 10, with reticulated foam 13 which is then in the form of a thick disc.

While specific embodiments of the invention have been shown and described in detail to illustrate the application of the principles of the invention, it will be understood that the invention may be embodied otherwise without departing from such principles.

What is claimed is:

1. An ear piece for a sound reproducing device, comprising an annular ear cushion of a size to engage against an outer ear and comprising at least one annular part of an elastic, soft, sound impermeable foam and at least one annular part of a sound permeable layer which is thin in relation to the overall thickness of said cushion and which has a defined acoustic impedance for low and medium frequencies of the audibility range and acts as a frictional resistance, a central portion of said ear cushion forming a coupling space from the sound producing device to the ear and the ear piece representing an acoustic connection from the sound producing device to the ear, the frictional resistance acting between the coupling space and an exterior of the coupling space.

2. An earpiece according to claim 1, wherein the sound producing device has a quadruple ($Z_K$) which, in an equivalent circuit, is connected to an impedance of the outer ear ($Z_G$) by a pair of parallel lines, with the cushion engaged against the outer ear, the sound producing system having a diaphragm which, in the equivalent circuit, corresponds to a series connected inductance ($L_M$) capacitance ($C_M$) and frictional resistance ($R_M$), connected in one of the parallel lines, the coupling space being represented in the equivalent circuit by a capacitance ($Z_K$) connected parallel to the ear impedance ($Z_G$) across the parallel lines, said sound permable laye having the defined acoustic impedance for low and medium frequencies which, in the equivalent circuit, comprise a frictional resistance (R) connected across the parallel lines and parallel to the ear impedance ($Z_G$).

3. An ear piece according to claim 2, wherein said sound permeable layer is made of reticulated foam.

4. An ear cushion according to claim 1, wherein said at least one part of elastic, soft, sound impermeable foam comprises two portions between which is disposed the other of said parts comprising said sound permeable layer which is thin in relation to the overall thickness of said cushion.

5. An ear piece according to claim 1 wherein said thin annular layer is disposed on the surface of said cushion facing the ear.

6. An ear piece according to claim 3, wherein said thin annular layer forms a part of a sound permeable disc which faces the ear and is contact with the outer ear.

7. An ear piece according to claim 1, wherein said thin annular layer comprises a reticulated foam.

8. An ear piece according to claim 1, wherein said thin annular layer comprises a sintered thermoplastic bead.

9. An ear piece according to claim 1, wherein said thin annular layer comprises a three-dimensional, woven metal lattice struction.

10. An ear piece according to claim 1, wherein said cushion has a side facing the person's ear which is covered by a thin elastic sound permeable layer.

* * * * *